US010352623B2

(12) United States Patent
Dupont

(10) Patent No.: US 10,352,623 B2
(45) Date of Patent: Jul. 16, 2019

(54) DIPHASIC COOLING LOOP WITH SATELLITE EVAPORATORS

(71) Applicant: EURO HEAT PIPES, Nivelles (BE)

(72) Inventor: Vincent Dupont, Brussels (BE)

(73) Assignee: EURO HEAT PIPES, Nivelles (BE)

( * ) Notice: Subject to any disclaimer, the term of this patent is extended or adjusted under 35 U.S.C. 154(b) by 161 days.

(21) Appl. No.: 15/546,618

(22) PCT Filed: Sep. 11, 2015

(86) PCT No.: PCT/EP2015/070883
§ 371 (c)(1),
(2) Date: Jul. 26, 2017

(87) PCT Pub. No.: WO2016/119921
PCT Pub. Date: Aug. 4, 2016

(65) Prior Publication Data

US 2018/0023900 A1 Jan. 25, 2018

(30) Foreign Application Priority Data

Jan. 27, 2015 (FR) ..... 15 50591

(51) Int. Cl.
*F28D 15/02* (2006.01)
*F28D 15/04* (2006.01)

(52) U.S. Cl.
CPC ..... *F28D 15/0266* (2013.01); *F28D 15/025* (2013.01); *F28D 15/04* (2013.01); *F28D 15/043* (2013.01); *F28D 2015/0216* (2013.01)

(58) Field of Classification Search
CPC .... F28D 15/0266; F28D 15/025; F28D 15/04; F28D 15/043; F28D 2015/0216; F28D 2021/0028; F28D 2021/0029; F28D 15/046; F28D 15/02; F28D 20/0034; H01L 23/46; H01L 23/44; H01L 23/473; H01L 23/4332; H01L 23/4338; H01L 23/4735; H01L 23/4336; A61L 9/037; A61L 9/127
USPC ..... 165/80.4, 104.26, 104.21, 104.19; 122/366
See application file for complete search history.

(56) References Cited

U.S. PATENT DOCUMENTS 4,492,266 A * 1/1985 Bizzell ..... F28D 15/043 122/366
4,898,231 A * 2/1990 Miyazaki ..... F28D 15/0233 165/104.25
5,725,049 A * 3/1998 Swanson ..... F28D 15/043 122/366
2002/0007937 A1* 1/2002 Kroliczek ..... F25B 23/006 165/104.26

(Continued)

*Primary Examiner* — Justin M Jonaitis
(74) *Attorney, Agent, or Firm* — Seed IP Law Group LLP

(57) ABSTRACT

A heat transfer system includes a main circuit forming a fluid loop, the main circuit being devoid of mechanical or capillary pumping means, at least one evaporator unit arranged in bypass to the main circuit, and at least one cooling heat exchanger that includes a portion of the loop main circuit and a heat exchanger coupled to a heat sink, for dissipating thermal energy. The evaporator unit includes an inlet pipe collecting liquid fluid from the main loop, an evaporator including a porous member with capillary pumping coupled to a heat source to be cooled, and an outlet pipe having an ejection nozzle with injects the fluid in primarily vapor phase into the main circuit at least in the loop direction of flow.

14 Claims, 6 Drawing Sheets

(56) References Cited

U.S. PATENT DOCUMENTS

Figure 1:
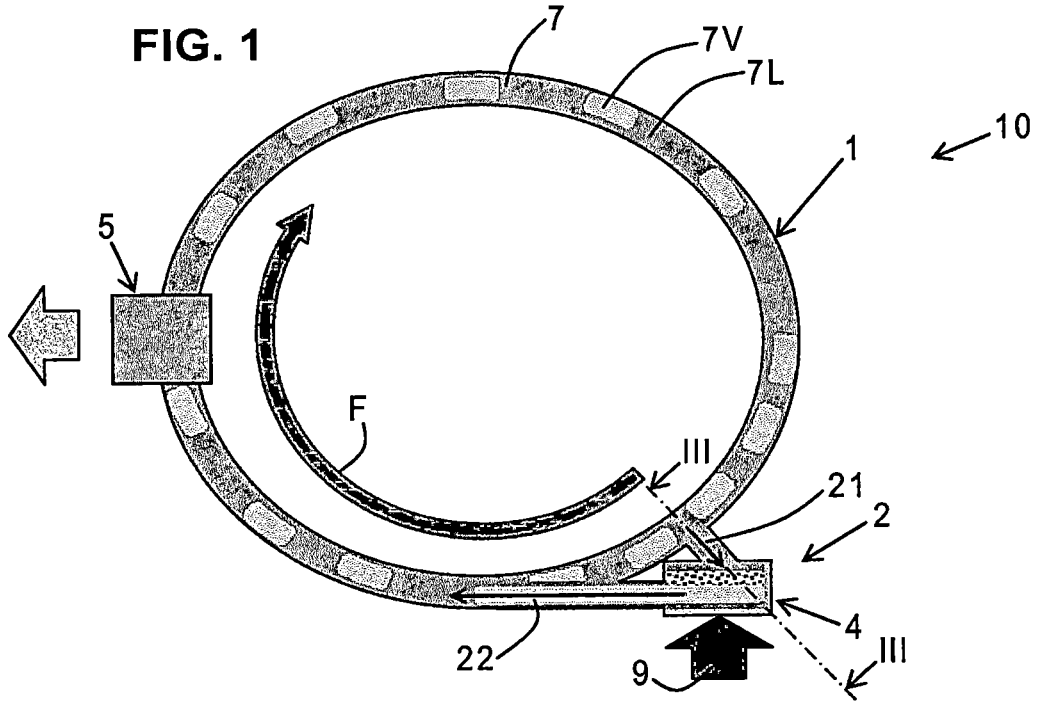

| | | | | |
|---|---|---|---|---|
| 2005/0061487 | A1* | 3/2005 | Kroliczek | F25B 23/006 165/139 |
| 2012/0132402 | A1* | 5/2012 | Aoki | F28D 15/0266 165/104.21 |
| 2012/0198859 | A1* | 8/2012 | Sepulveda | F25B 21/02 62/3.1 |
| 2013/0233521 | A1* | 9/2013 | Uchida | F28D 15/0266 165/104.26 |

* cited by examiner

DIPHASIC COOLING LOOP WITH SATELLITE EVAPORATORS

The invention relates to heat transfer systems, particularly loop heat pipes. This type of system is used to cool various devices and in particular to cool one or more processors of a circuit board.

It is known in the art to utilize advantageously the circulation of a two-phase fluid with an evaporator and a condenser, phase changes efficiently transporting heat from one point to another; the circulation of working fluid in the loop is generated by a thermosiphon effect or by a porous wick providing capillary pumping.

It is known to use such a system to cool circuit boards, particularly server boards of data centers.

In some circuit boards, there is not just one but multiple processors or electronic components to be cooled. Instead of multiplying the two-phase loops, some have suggested two evaporators and two condensers for the case of two processors arranged in series, as disclosed in U.S. patent document 2012/0132402. However, this solution is unsuitable if the thermal loads are not homogeneous, and in addition the startup may pose problems; plus instabilities are observed in the operation of such a loop. Another solution consists of placing several evaporators in a parallel arrangement on a two-phase loop, as disclosed in U.S. patent document 2002/0007937, but in such a configuration each evaporator increases the pressure losses in the loop without increasing the driving effect in the loop, and performance is then limited.

There is therefore a need to provide a more flexible solution that is suitable for cooling one or more processors or dissipative electronic components.

To this end, a heat transfer system is proposed that comprises:

a main circuit forming a fluid loop, the main circuit being devoid of mechanical or gravitational or capillary pumping means, with a direction of flow in the fluid loop, at least one evaporator unit arranged in bypass to the main circuit, with:

at least one inlet pipe, collecting liquid fluid from the main circuit, an evaporator including a porous member with capillary pumping, coupled to a heat source to be cooled, at least one outlet pipe having an ejection nozzle which injects the fluid in primarily vapor phase into the main circuit at least in the loop direction of flow, at least one cooling heat exchanger, comprising a portion of the loop main circuit and a heat exchanger coupled to a heat sink, for dissipating thermal energy.

With these arrangements, the injection of vapor from the outlet pipe into the main circuit has a driving effect by transfer of momentum. The jet of vapor forms a driving force in the loop main circuit, and one obtains a forced circulation of the working fluid in the main loop.

In some embodiments of the device according to the invention, one or more of the following arrangements may possibly be used.

In a first application, the fluid can essentially be in two-phase form in the loop main circuit, namely in vapor form and liquid form, the cooling heat exchanger in this case being a conventional condenser unit. There is thus no need for sub-cooling at the condenser(s). The absence of a need for sub-cooling allows limiting or even reducing the required size of the condenser or condensers. It is well known from the prior art that sub-cooled liquid is necessary to offset parasitic heat flux at the evaporator from the porous wick, the environment, possible capillary leakage, etc. This first application case thus eliminates this sub-cooling constraint.

In a second application case, the fluid may be substantially in liquid form in the loop main circuit, and the cooling heat exchanger is then a sub-cooling heat exchanger; this has the advantage of minimizing vapor pressure drops in the circulation of low pressure fluids in the loop main circuit; the condensation of vapor exiting the nozzle occurs in the immediately adjacent portion of the main circuit, downstream to the vapor injection point. The sub-cooling heat exchanger ensures sufficient sub-cooling for the liquid phase in the main circuit to remain liquid even in the presence of parasitic heat losses. The advantage of having substantially liquid in the main circuit is that there is very little impact on system operation from accelerations, for example in a vehicle with changing directions and highly variable intensities and it enables the use of low pressure fluids without causing unacceptable pressure losses.

Several evaporator units may be provided, each arranged in bypass to the main circuit; it is thus possible to cool two or more processors of a circuit board and/or a plurality of dissipative heat sources; this also benefits from an additive driving effect due to the injections of vapor of each evaporator unit.

In cases where the system is subject to the acceleration of gravity, the loop main circuit may advantageously lie in a plane that is substantially horizontal relative to gravity; preferably the fluid can circulate in the main loop without relying on a thermosiphon effect, the driving force in the main circuit being obtained by injections of vapor from the evaporator(s).

The evaporator(s) is (are) positioned below the main circuit;

Advantageously, one can benefit from a local siphon effect to supply liquid from the main pipe to the porous member, and the rise of bubbles of vapor and/or non-condensable gas toward the main conduit is incidentally facilitated.

The evaporator(s) can be positioned above the main circuit so as to ensure a minimum presence of vapor in contact with the porous member of the evaporator during the startup phase.

A secondary wick interposed between the porous member (also called the primary wick) and the main pipe may be provided in one or more evaporators; this allows efficient removal of the bubbles of vapor and/or non-condensable gases (NCG) via a capillary link, even in the absence of gravity, while ensuring the supply of liquid to the primary wick.

The ejection nozzle may be arranged inside the pipe of the main circuit, inside the piping itself. This optimizes the driving effect and the transfer of momentum.

The ejection nozzle may be parietally arranged on the wall of the main piping. Advantageously, one can then use a Y-shaped connector which is easy to incorporate while maintaining fluidtightness.

The system may further comprise a common reservoir connected to the main loop. One can thus control the operating conditions of the loop while controlling the saturation temperature Tsat, and it also serves as an expansion tank, thus eliminating the need to provide a reservoir function within each evaporator unit.

At one of the condenser (or sub-cooling) units, the main pipe may comprise a portion formed by a plurality of sub-channels arranged in parallel, for the purpose of limiting hydraulic head losses through this portion belonging to the condenser unit.

The system may further comprise one or more thermal bridge(s) thermally connecting the main pipe with one or more additional heat source(s). One can thus treat additional heat sources such as memory, which is certainly less dissipative than processors but which should also be cooled.

Figure 2:
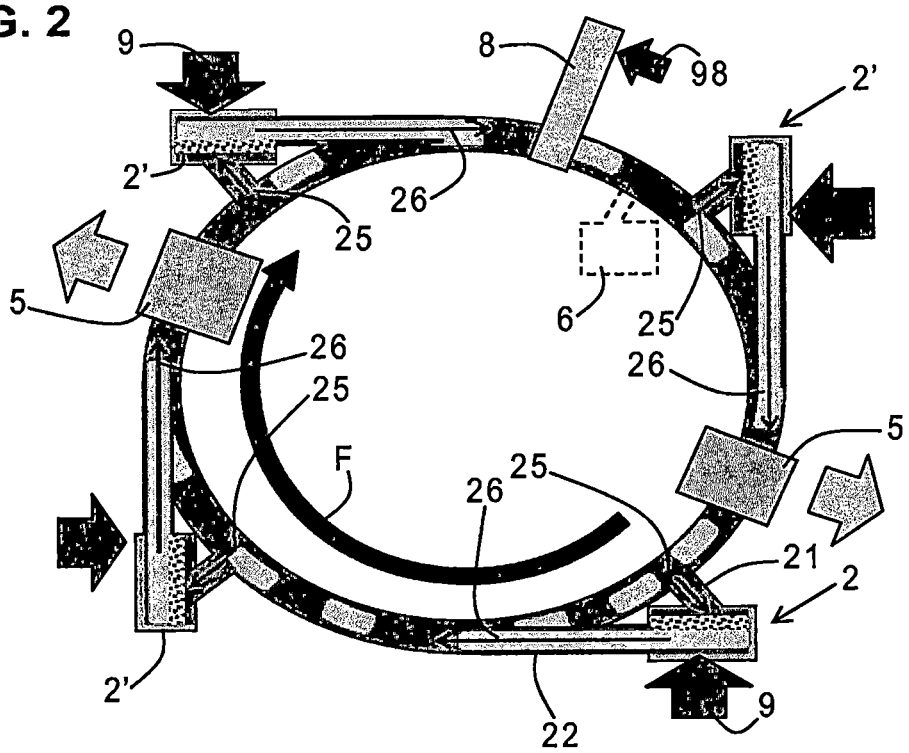
Figure 3:
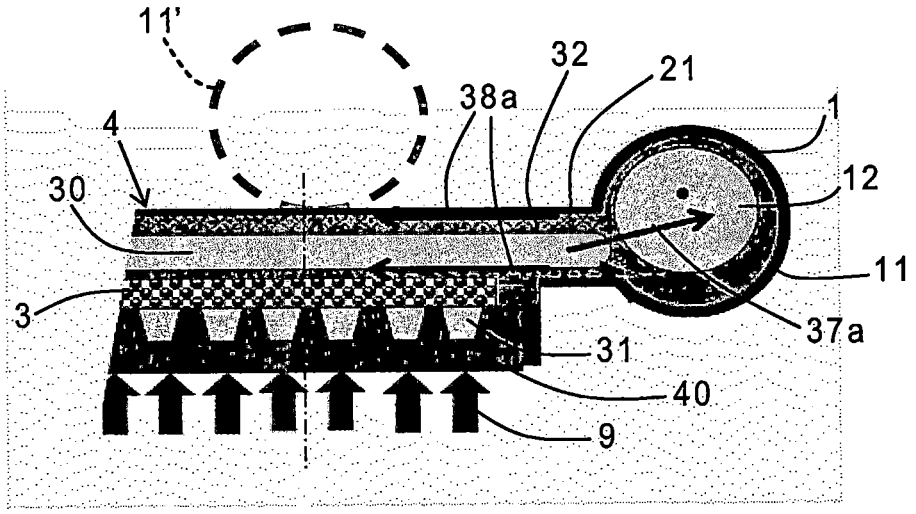
Figure 4:
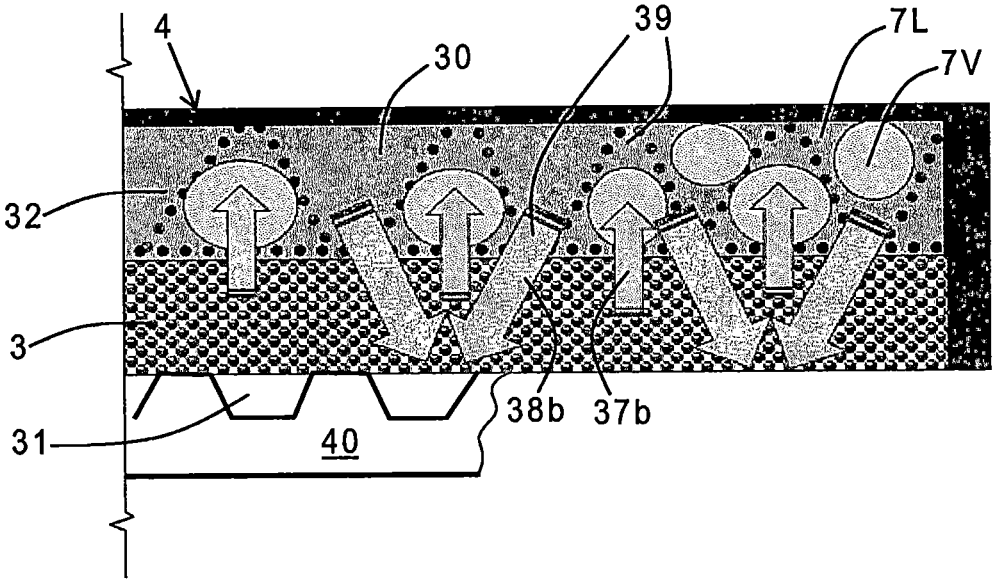
Figure 5A:
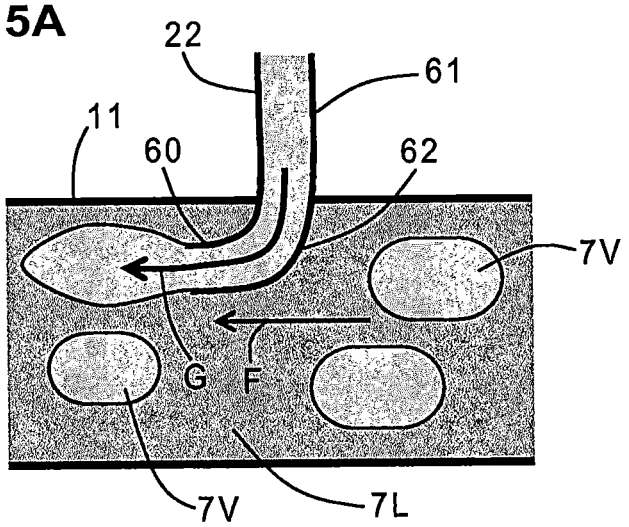
Figure 5B:
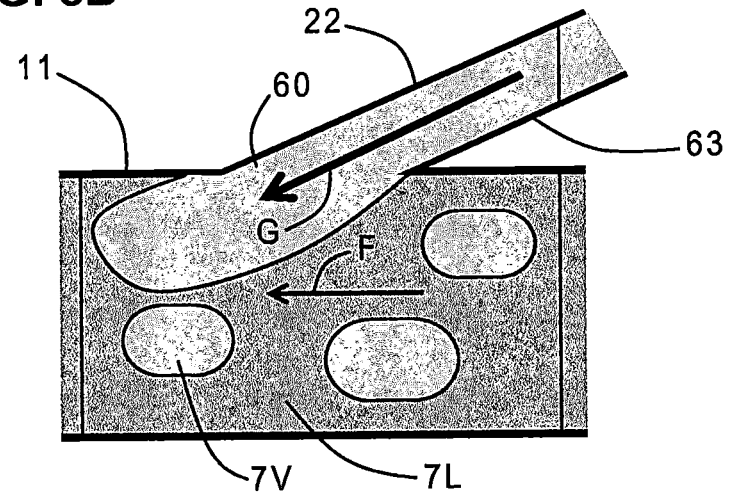
Figure 6:
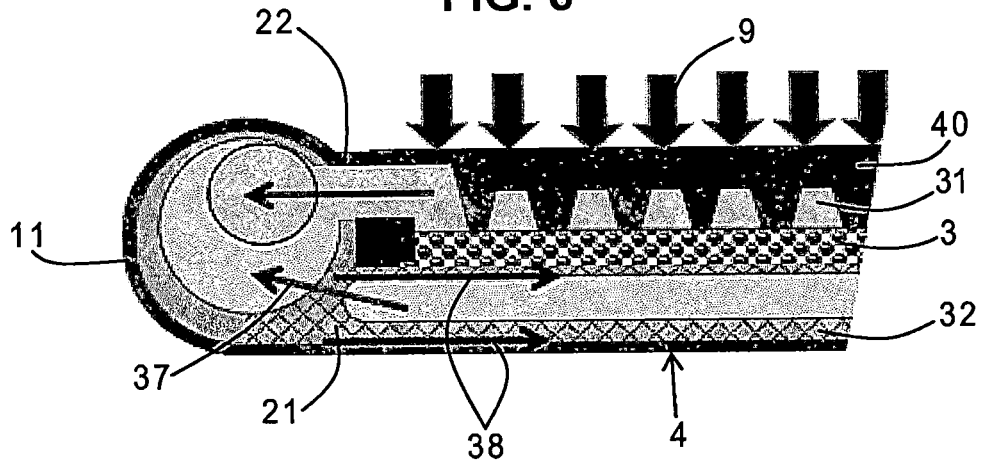
Figure 7:
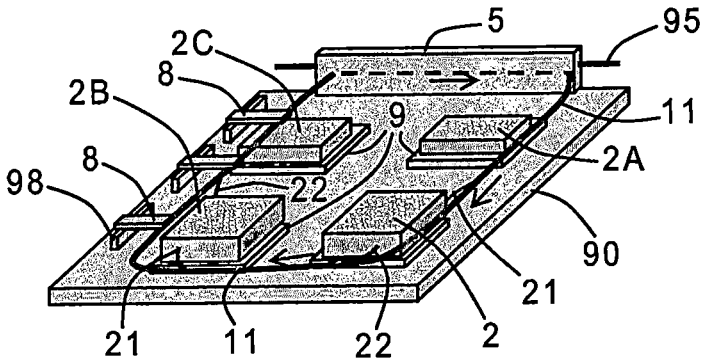
Figure 8:
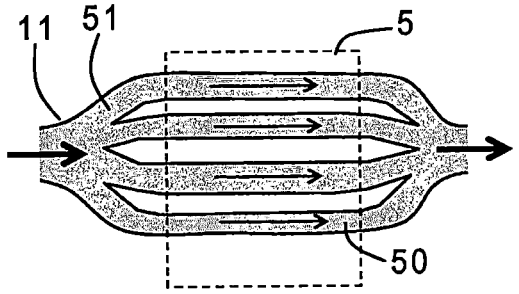
Figure 9:
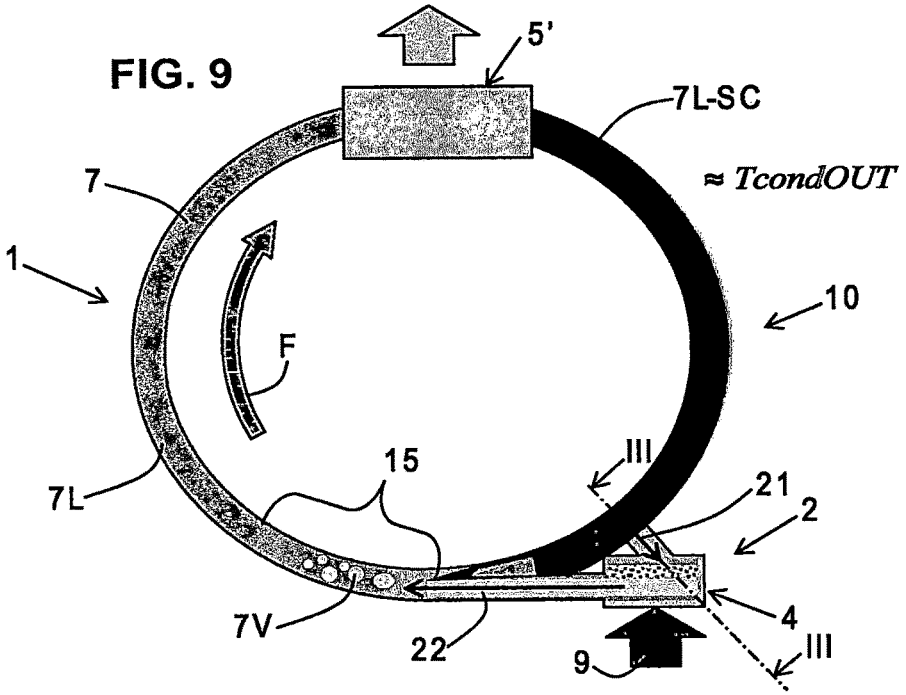
Figure 10:
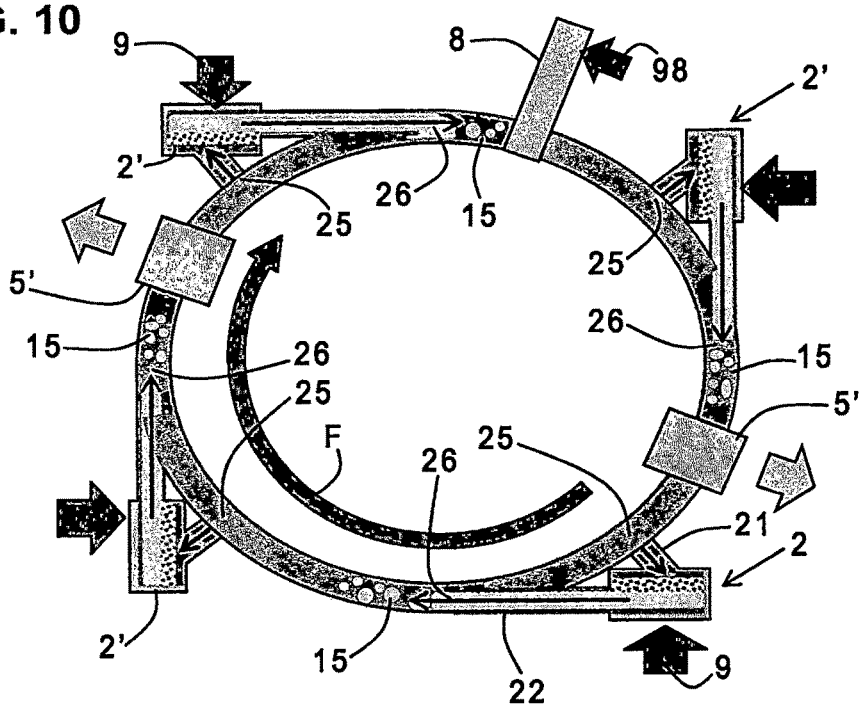
Figure 11:
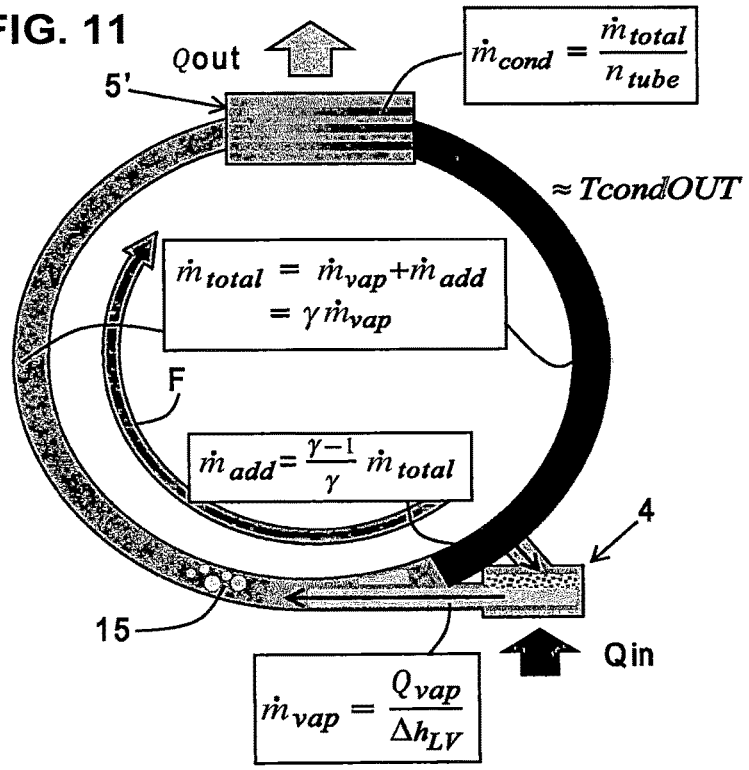
Figure 12:
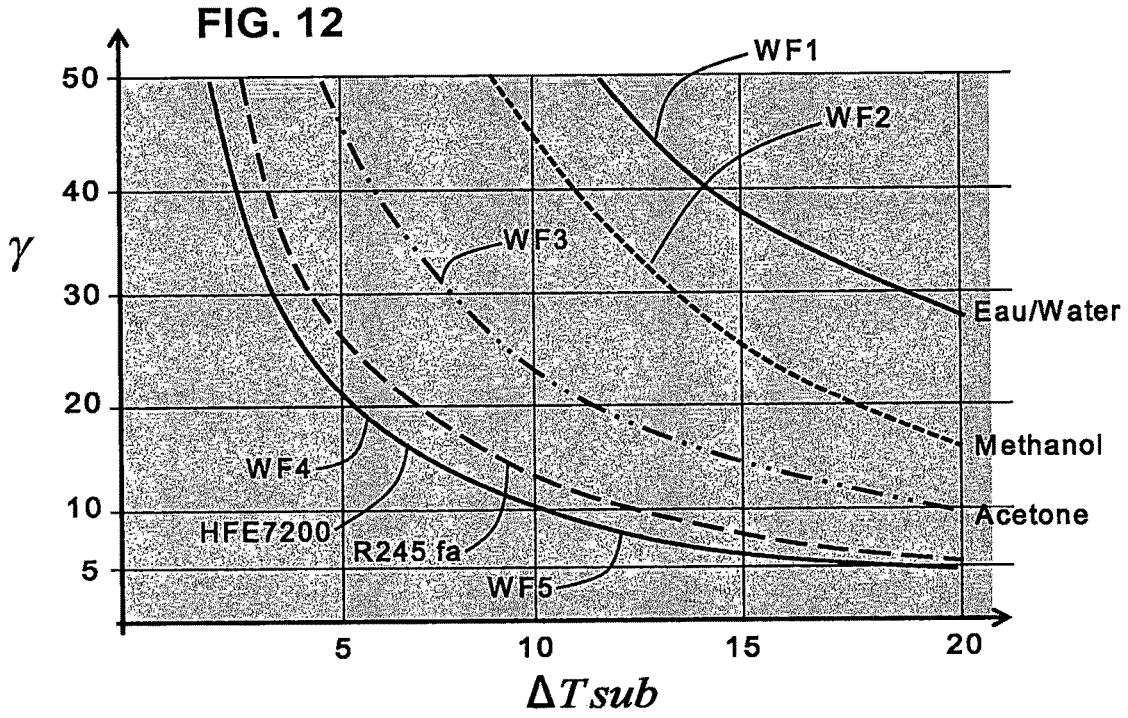

Other aspects, objects, and advantages of the invention will become apparent from reading the following description of one embodiment of the invention, given by way of non-limiting example. The invention will also be better understood with reference to the accompanying drawings, in which:

FIG. 1 is a schematic diagram of the system according to a first embodiment of the invention, with one evaporator unit, FIG. 2 is a schematic diagram of the system according to the invention with a plurality of evaporator units, FIG. 3 is a sectional view of an evaporator in a first arrangement, FIG. 4 is a more detailed partial sectional view of the evaporator of FIG. 3, FIGS. 5A and 5B are sectional views of the outlet pipe forming an injector where it joins the loop main circuit, FIG. 6 is a sectional view of an evaporator according to a second arrangement, FIG. 7 is a diagram illustrating the use of the heat transfer system of the invention in a multiprocessor server board, FIG. 8 shows an example configuration of the main piping at a condenser, FIG. 9 is similar to FIG. 1 and shows a second embodiment which is a variant in which the fluid is substantially in liquid phase in the main loop, FIG. 10 is similar to FIG. 2 but for the second embodiment, namely with the fluid substantially in liquid phase in the main loop, FIG. 11 illustrates the mass flow rate equations, FIG. 12 shows an exemplary chart of results for different fluids.

In the various figures, the same references designate identical or similar elements.

FIG. 1 shows a heat transfer system 10 using a two-phase working fluid 7 to collect thermal energy from a heat source 9 and transfer it away from the heat source. More specifically, the heat transfer system 10 comprises a loop main circuit 1. The heat transfer system 10 contains a given quantity of working fluid 7, in an interior volume isolated in a sealed manner from the outside environment.

In the present description, the term "loop main circuit 1" is understood to mean a pipe or channel 11 which loops back to itself to form a closed circuit for the working fluid 7, thus forming the "main pipe" as opposed to the other pipes used to connect the evaporators arranged in parallel. The main circuit is also called the "thermal bus" and/or "general heat collector."

It is understood that the main circuit generally contains no obstructing element that could interfere with the free circulation of the working fluid, this circulation occurring in a preferred direction of flow represented by the reference "F".

According to a first embodiment of the invention, the working fluid circulating in the main circuit generally comprises two phases, liquid phase and vapor phase, without excluding the presence of some locations where the fluid is substantially liquid 7L and other locations where the fluid is substantially vapor 7V.

According to a second embodiment, which will be described in detail further below, the working fluid circulating in the main circuit is substantially in liquid phase 7L.

According to the invention, the main circuit itself is devoid of mechanical or capillary or gravitational pumping means. The main circuit forms a loop which may have a generally circular, rectangular, square, or any other shape; similarly, the main circuit may have a two-dimensional shape (meaning it is substantially flat) or may be three-dimensional, meaning not flat. The cross-section of the piping may be substantially constant; however, it is not excluded that the cross-section of the piping may vary along the main circuit.

To pull thermal heat from the heat source 9, an evaporator unit 2 arranged in bypass to the main circuit is provided. This evaporator unit 2 comprises:

- at least one inlet pipe 21, collecting liquid fluid from the main loop,
- an evaporator 4 including a porous member 3 forming a capillary pump and coupled to a heat source to be cooled,
- at least one outlet pipe 22 having at least one ejection nozzle which injects the fluid primarily in vapor phase into the main circuit in the loop direction of flow F.

One will note that the hydraulic interface of the evaporator unit 2 with the main circuit 1 is confined to a liquid fluid collection connection and a vapor injection outlet. The injection of vapor into the main pipe may occur at the wall as is illustrated in FIG. 5B or may be positioned completely inside the main pipe as is illustrated in FIG. 5A. The vapor injection occurs at high velocity which causes a transfer of momentum to the surrounding working fluid in the main piping, as will be illustrated in more detail further below.

In the illustrated example, the inlet pipe 21 is separate from the outlet pipe 22; thus the evaporator unit is similar to a CPL (Capillary Pumped Loop) according to a classification known to those skilled in the art. However, one will note that the inlet 21 and outlet 22 pipes may be contiguous or adjacent. Also, each of the inlet 21 and outlet 22 pipes could be reduced to a simple passage without there necessarily being a tubular pipe or equivalent; in FIG. 3 the dotted line indicates a case where the main piping 11 is adjacent to the evaporator and in such case one and/or the other among the inlet 21 and outlet 22 pipes could be reduced to a simple passage.

The liquid collection point 25 via the inlet pipe 21 is located upstream (relative to the direction of flow F) to the vapor exit point 26 from the outlet pipe into the main pipe 11.

In addition, the system comprises a condenser unit 5 which transfers the thermal energy carried in the main pipe to a distance from the heat source(s). The condenser unit 5 is formed by a portion of the main duct itself and a heat exchanger coupled to a heat sink; this heat exchanger is deliberately not detailed here, as it can be of any type known in the art: for example an air-cooled heat exchanger with fins, possibly with forced convection with a fan; it can also be for example a liquid-cooled heat exchanger, for example a counter-flow heat exchanger with another liquid, for example water.

In a typical example of server boards, thermal energy from the processors is carried away through the main circuit to a distance from the server board, in a conventional water cooling circuit (FIG. 7).

The amount of working fluid within the heat transfer system is constant because the system as a whole is sealed relative to the environment. Depending on the volume available in the circuit and the evaporators, as well as the initial amount filled, the two-phase flow in the main piping may be either stratified or annular, laminar, or turbulent, with pockets of vapor of varying size. The type of flow and the design of the injection area will be chosen so as to obtain the most effective driving effect possible while minimizing viscous losses for the desired temperature and thermal power ranges.

In particular, according to the first embodiment, some portions of the main pipe may have a cross-section such that the vapor and liquid phases separate and stratify, naturally or due to gravitational or centrifugal force or due to any separation means applied as required for the environmental conditions under gravity or weightlessness and for the flow characteristics. The advantage of this phase separation is that large flow volumes of vapor, at high vapor velocity, can be conveyed in comparison to the low flow volumes of liquid generally required in two-phase transport systems. This phase separation significantly reduces pressure losses in the main pipe. The theoretical ratio of vapor flow rate/liquid flow rate is proportional to the density ratio between the liquid and the vapor. One can see the advantage provided by this phase separation, as the density ratio for high-pressure fluids can be 10 while it can be up to 100 or even 1000 for low-pressure fluids. In two-phase loops, it is often the vapor pressure loss which is predominant. The injectors are preferably arranged in the vapor phase, which directly or by a driving effect communicates a portion of the momentum to the liquid phase. The two-phase piping could be of any shape enabling this phase separation. An ovoid shape would encourage the vapor to be located in the enlarged upper portion of the piping and the liquid portion in the narrowed lower portion of the piping. The main piping could even be composed of several parts in parallel: a pipe for vapor and a pipe for liquid. In this particular case, the vapor pressure loss exerts a pumping effect on the line sections arranged parallel to the main pipe. The parallel secondary line or lines, of low flow velocity, are arranged to encourage liquid to occupy them while allowing the entrainment of possible vapor bubbles.

As illustrated in a more complete case in FIG. 2, the heat transfer system allows the dissipation of thermal energy from several heat sources 9 by means of several respective evaporator units 2,2' which are identical or merely similar in principle. Note that these evaporator units are all arranged in bypass to the main pipe, at different successive positions along this main circuit. Advantageously, due to this configuration, an additive driving effect is obtained by the rapid vapor injections, which are arranged in series along the main circuit (in contrast to the prior art configuration of evaporators arranged in parallel).

Moreover, it turns out that with this invention one can use conventional dielectric fluids such as refrigerants as the working fluid, thereby replacing the conventional fluids of the prior art used in two-phase loops, which are either flammable or hazardous to the environment. The low latent heat of these fluids is an advantage in reaching a significant vapor velocity at the nozzle which can be combined with the possibility of using multiple nozzles on the same evaporator. It is thus possible to use a wider variety of two-phase fluids for a given range of specified operating temperatures.

One can also provide several evaporator units 4 on the main circuit; in one example, there can be an evaporator followed by a condenser and so on in alternation, and of course it is understood from FIG. 2 that one can have any number of condensers relative to the number of evaporators. Similarly, the various evaporators and condensers can be in any order and relative position, and there can be any space between them.

As illustrated in FIG. 3, the evaporator 4 comprises a hot plate 40 receiving thermal energy from the heat source 9 and in which are arranged grooves 31 or vapor channels facilitating the elimination of the vapor 7V that forms at that location by evaporation.

The porous member 3, also called the primary wick, is in contact with the hot plate 40 (on the grooved side). It provides a pumping effect as is known in the prior art, due to the filling of the interstices of the porous structure 3 by fluid in its liquid phase. The porous member 3 may be made of stainless steel, nickel, ceramic, or even copper (see below).

In the liquid infeed area 30, the fluid in liquid phase is coming from the inlet pipe 21; one known concern of the prior art is preventing a plug of vapor and non-condensable gas from blocking the incoming liquid (vapor lock), and thus cutting off the supply of liquid phase at the evaporation area and depriming the capillary pump. Vapor bubbles can form in the liquid infeed area due to a poor capillary seal or parasitic heat flux (parasitic heating—liquid side). Thus the parasitic flux can be considered as an additional heat source that requires, in devices known to those skilled in the art, a flow rate of sub-cooled liquid to avoid depriming or a rise in the saturation temperature. Accordingly, in known devices there is a subsequent degradation of the total conductance of the device. In the present invention, the vapor and/or non-condensable gas is naturally discharged to the main circuit via the vapor core of the secondary capillary link, with no need for sub-cooling. The total conductance of the device is maintained by the invention even when the evaporator had parasitic leakage or leakage of non-condensable gas. The system becomes more robust than the capillary devices (CPL and LHP) known to persons skilled in the art.

In the prior art, attempts were made to prevent vapor bubbles from forming on the infeed side of the porous member in order to avoid interrupting the supply of liquid to the primary wick of the evaporator due to formation of a vapor lock; but here, given the configuration with the loop main circuit, we can tolerate the formation of such bubbles of vapor and non-condensable gas, provided they can "return upstream" from the inlet pipe 21 to the main pipe 11.

One can use gravity for this purpose if it prevails in the area of application, by forming a local siphon in which the gas bubbles rise and the liquid descends, as is shown in FIG. 3.

Additionally or alternatively, there may also be provided an optional secondary wick 32, which is on the opposite side of the primary wick relative to the hot plate 40. This secondary wick 32 extends into the body of the evaporator, and may also extend at least partially into the inlet pipe 21; in effect, the secondary wick 32 is interposed between the primary wick 3 and the pipe 11 of the main circuit.

This secondary wick 32 forms a channel to evacuate any gas bubbles that may have formed at this location, meaning the wrong side of the primary wick 3; one thus prevents vapor lock from interrupting the continuous supply of liquid fluid from the main pipe to the primary wick 3 of the evaporator 4.

The secondary wick 32 may be formed by a wire mesh as is illustrated in FIG. 4. In the corners or at the intersections of the mesh wires of the secondary wick, menisci 39 of liquid may form which ensure a good supply of liquid to the primary wick.

As the formation of vapor bubbles on the infeed side (liquid) of the porous member can be tolerated, it is advantageously unnecessary to ensure perfect capillary sealing to separate the spaces on each side of the porous member 3. As a result, the manufacturing constraints and the cost of the evaporator can be reduced.

Parasitic heat flux, regardless of the orientation of the evaporator, can be compensated for by managing the removal of vapor bubbles formed on the infeed side of the porous member, and this can be done with no need for a flow of sub-cooled liquid.

Similarly, there is no need to pressurize the main circuit during startup phases because even if vapor bubbles form in the evaporator on the wrong side of the porous member, these bubbles will be returned to the main circuit and then condensed in the main circuit.

In the configuration illustrated in FIG. 3, the hot plate 40 is located above the heat source 9 to be cooled, the porous member 3 is located above the hot plate 40, and the liquid infeed area 30 containing the optional secondary wick is located above the porous member 3.

In FIG. 6, in another arrangement of the evaporator that is generally inverted compared to FIG. 4, the evaporator comprises the heat-receiving hot plate 40 arranged on top with the grooves 31 in contact with the porous member 3, then the secondary wick 32 below that.

The arrival of liquid at the porous member is indicated by arrows 38*a*, 38*b*, while any bubbles of vapor and/or non-condensable gas join the pocket of vapor 12 as indicated by the arrows denoted 37*b*, 37*a*.

As discussed above, and unlike the prior art, parasitic heat flux is tolerated by the system and has no effect on its performance. Advantageously, as illustrated, the evaporator can be in any orientation relative to gravity, due to the presence of the secondary wick 32 which ensures the supply of liquid by capillary pumping as well as the escape of vapor (see above). Similarly, as the properties of thermal conductivity have no impact on parasitic flux from the porous wick 3, this allows the use of copper (not recommended in the prior art because it is too good of a heat conductor) as the porous member, which greatly improves the performance of the evaporation area.

Advantageously according to the present invention, the relative positions of the evaporator unit 2 and the main piping 11 may be such that, as shown in FIG. 6, the grooves of the evaporator are not filled with liquid at startup. Startup is then facilitated by the presence of vapor in the grooves. The secondary wick contributes to the proper supply of liquid to the liquid infeed area and to the return of vapor bubbles to the main pipe.

The invention presented here can be used in microgravity situations, meaning in space, but of course also in gravity (land applications). The invention can of course be used on board transport vehicles (road, rail, air, etc.) which undergo accelerations in one or more directions, the secondary wick 32 managing the supply of liquid fluid and the return of any vapor bubbles.

As illustrated in FIG. 5B, the outlet pipe can be connected by a Y-shaped connector denoted 63; as illustrated in FIG. 5A, the outlet pipe can be connected with a perpendicular infeed 61 and a bend 62.

Note that to achieve the desired driving effect, it is sufficient for the injection direction of the vapor G to have a main component in the circumferential direction F, even if it also has another (radial) component as in the case in FIG. 5B.

The vapor injection occurs by means of an ejection nozzle 60, which can have a cylindrical or conical shape.

The nozzle 60 at the evaporator outlet may advantageously have an opening of self-adjusting cross-section which allows maximizing the momentum at low flow rates, low thermal loads, of the evaporator, while limiting pressure loss below the capillary pumping pressure of the evaporator at high flow rates. This self-adjustment can usefully be obtained by the spring effect of a blade closing off the nozzle, by thermal expansion of a bimetal strip, or by any other means producing the same effect.

One can also have several injection nozzles. In a variant not shown in the figures, the injection nozzles may be formed by the ends of the grooves 31 collecting vapor from the evaporator, which open obliquely and directly into the main pipe; one can thus have as many injection nozzles as there are collecting grooves 31.

In one particular configuration, a reservoir 6 (see FIG. 2.) fluidly connected to the main pipe is provided; this optional reservoir serves as an expansion vessel for excess working fluid depending on the operating temperature; this reservoir also serves where appropriate for actively controlling the prevailing saturation temperature Tsat at the vapor-liquid interface in this reservoir, which therefore affects the temperature and pressure at equilibrium in the system as a whole.

For additional heat sources 98 of lower thermal energy, instead of adding on a capillary evaporator we also have the possibility of forming a thermal bridge 8 by using a part having a good thermal conductivity coefficient, a conventional thermal bridge, or a conventional heat pipe. Thermal energy is transferred to the working fluid 7 primarily by convection boiling 7 at the contact between the thermal bridge 8 and the main piping 11; this convection boiling takes place with a good heat-exchange coefficient.

FIG. 7 illustrates the use of a heat transfer system as explained above, in its application to a multiprocessor server board 90 comprising multiple processors 9 to be cooled by capillary evaporator and possibly secondary components as well such as memories 98 to be cooled by thermal bridge 8.

As illustrated in FIG. 7, each processor 9 has an evaporator 2, 2A, 2B, 2C mounted atop it, and the main circuit 11 extends along the board 90 and passes near each of the evaporators, either along the side or above. Thermal bridges thermally connect the memory sticks 98 to the main circuit 11. A condenser 5 is arranged at one end of the board 90 and enables heat exchange between the working fluid 7 of the main circuit and a general water cooling circuit 95 shared for example by multiple server boards.

However, it should be noted that the invention can be applied in any type of system, electronic or other, stationary or mobile, in any technical field.

Advantageously according to the invention, a modular system is proposed, meaning a main circuit which can be standardized, to which are added a number of evaporators in parallel, their number varying according to the configuration of the server board to be cooled. As is illustrated by FIGS. 1 and 2, an evaporator unit can be added or removed without changing the concept and design of the rest of the system.

According to some possible implementations, the transverse dimension of the main pipe may range from 2 mm to 25 mm and its cross-section may range from 3 $mm^2$ to 10 $cm^2$; the transverse dimension of the injection nozzle may be of the same dimension, smaller in dimension, or significantly smaller in dimension. The ratio of the nozzle cross-section and the main pipe cross-section may range from 1 to 1/30.

According to some possible implementations, the velocity of the two-phase flow in the general pipe can range from 1 m/s to 100 m/s.

According to some possible implementations, the fluid used may be methanol, ethanol, acetone, R245fa, HFE-7200, R134A, or their equivalents.

FIG. 8 illustrates a portion of the main circuit 11 that is part of a condenser unit 5; in this portion, the main piping is divided into several sub-channels 50, thereby increasing the heat exchange while limiting hydraulic head losses through this area. Distribution of the two-phase flow from the main pipe is achieved by a manifold 51 of the state of the art so as to ensure the most uniform distribution possible of the liquid and vapor phases in each of the branches 50 (proportion of vapor).

Second Embodiment

FIGS. 9 and 10 illustrate a second embodiment of the present invention, in which the fluid circulating in the main loop is generally sub-cooled relative to the saturation temperature Tsat, and therefore the fluid is substantially in liquid phase except in the outlet areas of the ejection nozzles 22,26.

The arrangement and operation of the evaporator unit 2 and the evaporator 4 itself is similar or identical to what was described for the first embodiment, and therefore will not be repeated here. Only features that differ from the first embodiment are presented below.

In place of the conventional condenser unit of the first embodiment, the cooling heat exchanger of the system which transfers thermal energy to the exterior, denoted 5' here, is a sub-cooler type of exchanger which sub-cools the liquid 7L-SC to below the saturation temperature Tsat.

The state change from vapor phase to liquid phase occurs in a portion 15 of the pipe of the main circuit just downstream of the ejection nozzle which forms the outlet of the evaporator 4.

This condensation occurs at contact with the sub-cooled liquid arriving from upstream due to the direction of circulation F, and also potentially at contact with the wall of the pipe which itself is at a temperature close to TcondOUT corresponding to that of the sub-cooled liquid 7L-SC.

The vapor is ejected as a jet at the outlet of the ejection nozzle, in some cases for example in the form of vapor bubbles that are ejected in a turbulent flow; and the size and number of the bubbles decreases gradually as one moves away from the ejection nozzle, due to the condensation process.

Therefore it is the pipe portion denoted 15 which acts as the condenser ("condensation zone") in this system.

FIG. 9 illustrates a configuration with a single evaporator unit 2 and a single sub-cooling heat exchanger 5'.

In FIG. 10, a configuration is illustrated with four evaporator units 2,2' and two sub-cooling heat exchangers 5', the other elements being similar to what has already been described for FIG. 2. Note the condensation zone 15 downstream of each vapor outlet from an evaporator unit.

Referring to FIG. 11, let us analyze the mass flow rate for the configuration where an evaporator unit is a sub-cooling heat exchanger in steady state.

For the mass flow rate of vapor exiting the evaporator:

$$\dot{m}vap = \frac{Qvap}{\Delta h_{LV}}$$

also written as:

$$\frac{dmvap}{dt} = Qvap / \Delta h_{LV}$$

ṁvap being the vapor mass flow rate exiting the evaporator unit, $Q_{vap}$ the heat of vaporization, and $\Delta h_{Lv}$ the latent heat of vaporization.

The mass flow rate in the main circuit is defined as:

$$\dot{m}_{total} = \dot{m}_{vap} + \dot{m}_{add} = \gamma \dot{m}_{vap}$$

The mass flow rate in the cooling heat exchanger is defined as:

$\dot{m}_{cond} = \dot{m}_{total} / n_{tube}$, where $n_{tube}$ is the number of parallel flows The mass flow rate in parallel of the evaporator is defined as:

$$\dot{m}_{add} = \frac{\gamma - 1}{\gamma} \dot{m}_{total}$$

Note that the γ coefficient characterizes the mass amplification effect provided by high speed ejection into the main circuit.

The mass flow rate in the main circuit is γ times greater than the mass flow rate in the evaporator.

We can thus write the following equations, which lead to expressing the γ coefficient as a function of the sub-cooling.

$Q_{in} = Q_{out} = \dot{m}_{vap} \Delta h_{LV}$, (in an ideal case without parasitic heat flux)

$Q_{sub} = \gamma \dot{m}_{vap} Cp_L$ ($T$sat−$T$condOUT), *ub* expressing the thermal energy transferred at the sub-cooling heat exchanger 5'.

$\Delta T$sub=$T$sat−$T$condOUT

We then write:

$$\gamma = \frac{\Delta hLV}{CpL \cdot \Delta Tsub}$$

FIG. 12 shows results characterizing the relation between the need for sub-cooling ΔTsub and the γcoefficient. Curves are given for the fluid water (denoted WF1), for methanol WF2, for acetone WF3, for HFE200 WR4, and R245fa WF5.

One can see that the γ coefficient varies between 5 and 50 for some fluids, between 10 and 50 for others. It is evident that in the invention it is more advantageous to use fluids with low latent heat of vaporization, not only in order reduce the need for sub-cooling but also to generate a greater pumping effect by the nozzles.

An important benefit of the predominant presence of liquid in the loop main circuit ensemble is the behavior of the system when subjected to acceleration, particularly variable acceleration. This is the case when the system is installed on board a land, sea, or air vehicle, such as urban transportation systems (subway or tram), and air transport such as an aircraft or drone. Conversely, if a portion of the main circuit comprises a significant portion of gas phase as is the case in capillary loops currently known to those skilled in the art, then the effects of hydrostatic pressure under acceleration tend to move the denser liquid phase in the direction of the acceleration, which may be opposite to the normal direction of circulation of working fluid in the loop. This type of interference is eliminated if the entire loop predominantly contains liquid.

The concept of acceleration also refers to the acceleration of gravity, meaning the relative position of the heat exchanger with respect to the evaporator. This position has limited impact on system performance when the main circuit is primarily occupied by liquid.

It should be noted that for the first embodiment, one can also define a $\gamma$ coefficient which varies between 5 and 50, preferably between 10 and 25, and generally less than that of the second embodiment.

The invention claimed is:

1. A heat transfer system comprising:

a main circuit forming a fluid loop, the main circuit being devoid of mechanical, gravitational and capillary pumping means, with a direction of flow in the fluid loop, at least one evaporator unit arranged in bypass to the main circuit, the at least one evaporator unit including at least one inlet pipe arranged to collect liquid fluid from the main circuit, an evaporator including a porous member with capillary pumping, coupled to a heat source to be cooled, at least one outlet pipe having an ejection nozzle which injects the fluid in primarily vapor phase into the main circuit at least in the direction of flow, at least one cooling heat exchanger, comprising a portion of the main circuit and a heat exchanger for dissipating thermal energy.

2. The heat transfer system according to claim 1, wherein the fluid is in two-phase form in the main circuit, namely in vapor form and liquid form, and the cooling heat exchanger is a condenser unit.

3. The heat transfer system according to claim 1, wherein the fluid is substantially in liquid form in the main circuit and the cooling heat exchanger is sub-cooling heat exchanger.

4. The heat transfer system according to claim 3, wherein a state change from vapor phase to liquid phase occurs in a portion of a pipe of the main circuit just downstream of the ejection nozzle.

5. The heat transfer system according to claim 1, wherein the at least one evaporator unit includes several evaporator units arranged in bypass to the main circuit.

6. The heat transfer system according to claim 1, subject to the gravity of earth, wherein the main circuit lies in a plane that is substantially horizontal relative to gravity.

7. The heat transfer system according to claim 6, wherein the evaporator of the at least one evaporator unit is positioned below the main circuit.

8. The heat transfer system according to claim 6, wherein the evaporator of the at least one evaporator unit is positioned above the main circuit.

9. The heat transfer system according to claim 1, wherein the evaporator of the at least one evaporator unit includes a secondary wick (32) interposed between the porous member and the main circuit.

10. The heat transfer system according to claim 1, wherein the ejection nozzle is arranged inside a main pipe of the main circuit.

11. The heat transfer system according to claim 1, wherein the ejection nozzle is parietally arranged on a wall of a main pipe of the main circuit.

12. The heat transfer system according to claim 1, further comprising a common reservoir connected to the main circuit.

13. The heat transfer system according to claim 1, wherein, at one of the cooling heat exchangers, the main circuit comprises a portion formed by a plurality of sub-channels arranged in parallel.

14. The heat transfer system according to claim 1, further comprising one or more thermal bridge(s) thermally connecting the main circuit with one or more additional heat source(s).

* * * * *